US006601741B2

(12) United States Patent
McGuffey

(10) Patent No.: US 6,601,741 B2
(45) Date of Patent: Aug. 5, 2003

(54) LAMINATED DISTRIBUTION MANIFOLD PLATE SYSTEM

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/994,881

(22) Filed: Nov. 28, 2001

(65) Prior Publication Data

US 2003/0098317 A1 May 29, 2003

(51) Int. Cl.[7] ..... B67D 5/06

(52) U.S. Cl. ..... 222/504; 222/318; 222/330; 222/146.2; 239/135; 137/884

(58) Field of Search ..... 222/318, 330, 222/504, 565, 146.2, 136; 239/128, 133, 134, 135; 137/884; 425/7

(56) References Cited

U.S. PATENT DOCUMENTS 4,082,324 A * 4/1978 Obrecht ..... 285/124.5
4,687,137 A 8/1987 Boger et al.
4,983,109 A 1/1991 Miller et al.
5,000,112 A * 3/1991 Rothen et al. ..... 118/411
5,048,569 A * 9/1991 Stoll et al. ..... 137/625.64
5,236,641 A 8/1993 Allen et al.
5,458,291 A * 10/1995 Brusko et al. ..... 239/423
5,458,684 A * 10/1995 Miller et al. ..... 118/602
5,478,224 A * 12/1995 McGuffey ..... 425/7
5,620,139 A * 4/1997 Ziecker ..... 239/124
5,823,437 A 10/1998 Bolyard, Jr.
5,862,986 A 1/1999 Bolyard, Jr. et al.
5,882,573 A 3/1999 Kwok et al.
5,893,394 A * 4/1999 Meloche ..... 137/884
5,902,540 A 5/1999 Kwok
5,904,298 A 5/1999 Kwok et al.
6,051,180 A 4/2000 Kwok
6,161,722 A * 12/2000 Sooudi et al. ..... 222/1
6,168,049 B1 * 1/2001 Bolyard, Jr. ..... 222/189.06
6,260,583 B1 * 7/2001 Flatt et al. ..... 137/884
6,286,551 B1 * 9/2001 Flatt et al. ..... 137/884
6,375,099 B1 * 4/2002 McGuffey ..... 239/553.5
6,419,126 B2 * 7/2002 Righolt ..... 222/330
6,499,631 B2 * 12/2002 Zook ..... 222/146.6
6,540,831 B1 * 4/2003 Craine et al. ..... 118/314

* cited by examiner

*Primary Examiner*—Gene Mancene
*Assistant Examiner*—Frederick C. Nicolas
(74) *Attorney, Agent, or Firm*—Schwartz & Weinrieb

(57) ABSTRACT

A hot melt adhesive material flow control system comprises an input manifold for receiving a supply of adhesive material, a plurality of flow control valves from which the adhesive material is discharged, an output manifold for heating the adhesive material and conducting the hot melt adhesive material to the flow control valves, a pair of multiple outlet pumps for supplying the adhesive material to the flow control valves, and a recirculation pump for recirculating adhesive material back from the flow control valves to the pair of multiple outlet pumps. A distribution plate and a recirculation plate are interposed between the input and output manifolds and have separate and independent fluid circuits or flow paths defined upon opposite surfaces thereof. In this manner, the number of plates required to define the flow paths is significantly reduced. In addition, the output manifold, the flow control valves, the recirculation pump, and the multiple outlet pumps are independently mounted upon the input manifold so as to simply disassembly and reassembly of the components in connection with maintenance, cleaning, replacement, or repair operations.

25 Claims, 6 Drawing Sheets

460
78
454
454
13
80
82
422
14
84
452
452
12
86
88
62
60
76
64
74
92
66
72
58
68
460
90
70
420

10
ADHESIVE SUPPLY
30
22
56
54
418
202
208
40
36
34
166
24
16
416
38
44
220
136
178
442
254
26
248
160
412
238
244
414
236
28
18
442
440
20
434
234
20
434
340
302
20
430
430

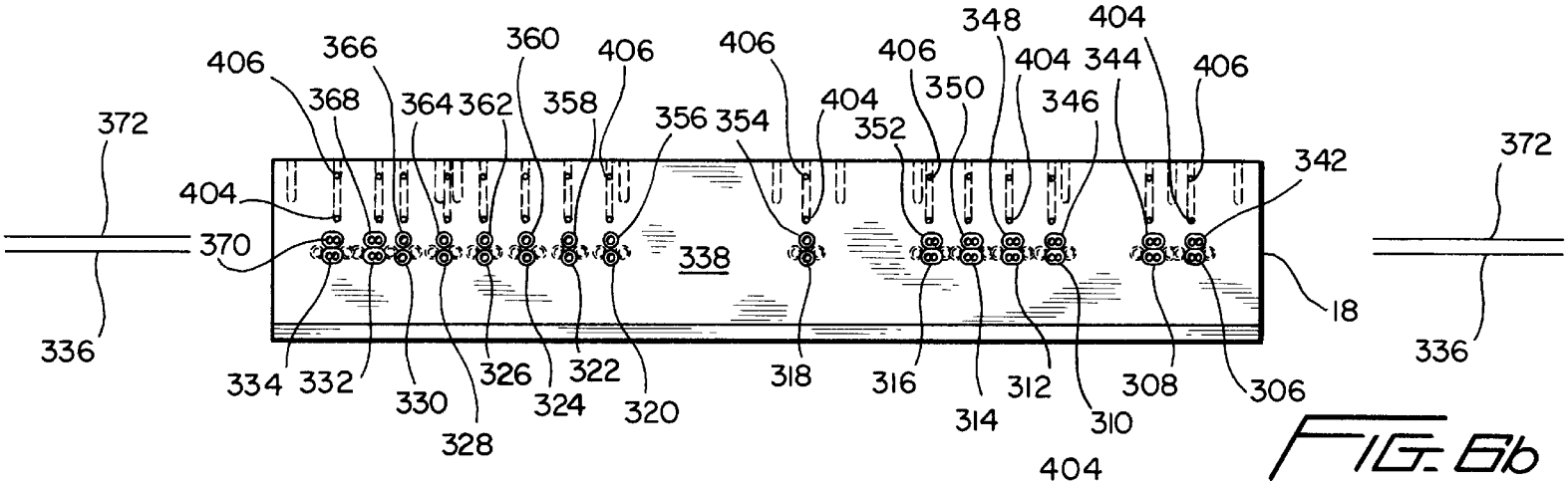
FIG. 6b
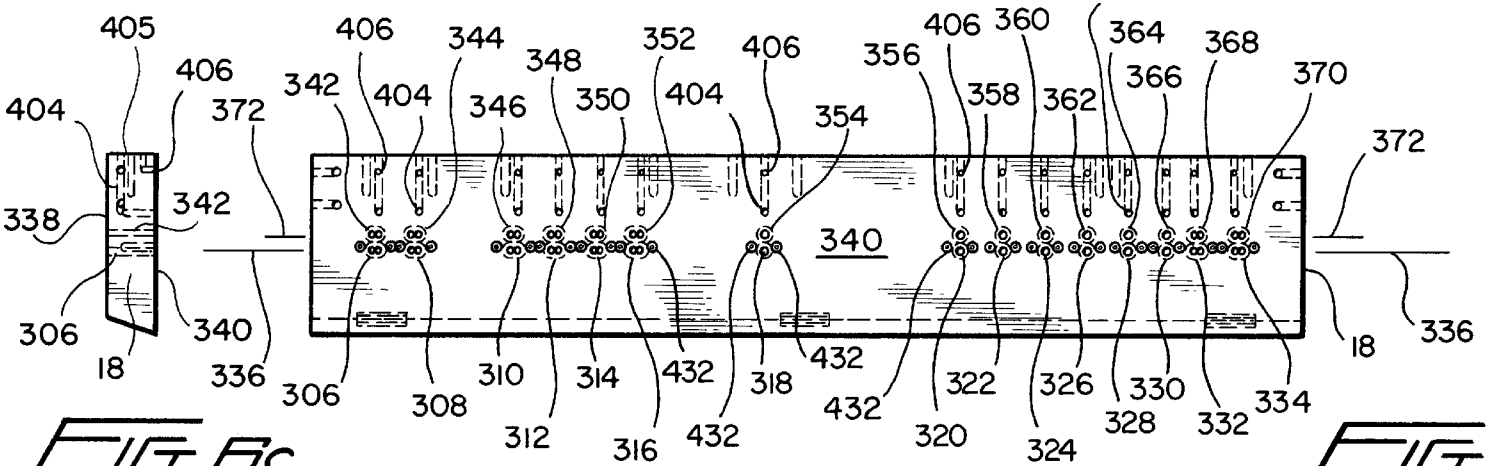
FIG. 6a
FIG. 6c

LAMINATED DISTRIBUTION MANIFOLD PLATE SYSTEM

FIELD OF THE INVENTION

The present invention relates generally to hot melt adhesive material dispensing systems, and more particularly to a new and improved hot melt adhesive material dispensing system, comprising a pair of multiple-outlet gear pumps for supplying hot melt adhesive material to a plurality of diversion flow valves, and a plurality of adhesive manifold plates for conducting or routing the adhesive material from the multiple-outlet gear pumps to the individual diversion flow valves, wherein, firstly, in order to in fact supply the hot melt adhesive material to particular ones of the plurality of diversion flow valves located at particular longituindally arrayed locations, fluid flow circuits are effectively provided upon opposite sides of a plurality of adhesive manifold plates so as to in fact achieve the particular fluid flow circuitry as desired and required while nevertheless minimizing the number of adhesive manifold plates, the number of seals operatively associated with such manifold plates, and the potential leakage paths or sites normally present in conjunction with a larger number of adhesive manifold plates, and wherein, secondly, assembly and disassembly procedures for the system are simplified.

BACKGROUND OF THE INVENTION

In connection with hot melt adhesive material dispensing systems for dispensing hot melt adhesive materials through means of, for example, a plurality of flow control valves or discharge valves fluidically connected to a plurality of downstream dispensing or discharge nozzles which are arranged within a predetermined array so as to deposit the hot melt adhesive material at predetermined locations, or within a predetermined pattern, upon a particular substrate, the hot melt adhesive material is routed from a suitable source or supply of hot melt adhesive material, through one or more supply pumps, and through a plurality of fluid flow paths fluidically connecting the supply pump or pumps to the aforenoted discharge or flow control valves and the dispensing nozzles. When a substantially large number of discharge or flow control valves, and operatively associated or fluidically connected dispensing nozzles, are employed within a particular system in order to achieve the deposition of the hot melt adhesive material in accordance with a particular or predetermined pattern upon a particular substrate, the fluidic logistics of such a system can become quite intricate and complex. More particularly, and as is conventional, the system usually comprises an adhesive manifold which comprises a plurality of adhesive manifold plates for fluidically conducting or routing the adhesive material from the output or supply pumps to the individual flow control valves. However, since each fluid flow path from the one or more output or supply pumps to each individual flow control valve and its operatively associated dispensing nozzle must effectively be separate and distinct from the other fluid flow paths extending from the one or more output or supply pumps to the other individual flow control valves and their operatively associated dispensing nozzles, an inordinate number of fluid path separation plates, seal members, and the like are necessarily required in order to render the system fluidically viable. As has been noted, however, the number of such structural components renders the system intricate and complex, and in addition, also presents an undesirably large number of sites or locations from which potential leakage problems can occur. Still further, if cleaning, maintenance, repair, or replacement operations are to be performed in connection with any one of the major components of such conventional hot melt adhesive dispensing systems, all of the components have to be disassembled and ultimately reassembled. These operations are obviously tedious, time-consuming, and costly in connection with productivity down-time.

A need therefore exists in the art for a new and improved hot melt adhesive material dispensing system for use in connection with a pair of multiple-outlet or multiple-output planetary metering gear pumps for supplying hot melt adhesive material to a plurality of diversion flow control valves wherein, in order to in fact supply, route, or conduct the hot melt adhesive material from the multiple-output gear pumps to the individual diversion flow valves in order to achieve a particular hot melt adhesive deposition pattern, the particular fluid flow circuitry as desired and required must be provided, however, the number of adhesive manifold plates needs to be reduced so as to minimize the overall size of the adhesive manifold, the number of seals operatively associated with the plurality of adhesive manifold plates, and the number of potential leakage paths or sites which would normally or otherwise be present in conjunction with a larger number of adhesive manifold plates characteristic of conventional or PRIOR ART adhesive manifolds utilized within conventional or PRIOR ART hot melt adhesive material dispensing systems. In addition, a need exists for a new and improved hot melt adhesive material dispensing system wherein the various major components of the system are independently mounted or disposed within the overall system, as opposed to dependent upon or interdependent with the other major components of the system, whereby if a particular major component of the system needs to be cleaned, maintained, repaired, or replaced, the other major components of the system do not necessarily have to be disassembled and reassembled.

OBJECTS OF THE INVENTION

Accordingly, it is an object of the present invention to provide a new and improved hot melt adhesive material dispensing system for dispensing hot melt adhesive materials to an array of flow control valves.

Another object of the present invention is to provide a new and improved hot melt adhesive material dispensing system for use in connection with a pair of multiple-outlet or multiple-output planetary metering gear pumps for supplying hot melt adhesive material to an array of diversion flow control valves.

An additional object of the present invention is to provide a new and improved hot melt adhesive material dispensing system for use in connection with a pair of multiple-outlet or multiple-output planetary metering gear pumps for supplying hot melt adhesive material to an array of diversion flow control valves wherein such system can effectively overcome the various operational drawbacks and disadvantages characteristic of conventional or PRIOR ART hot melt adhesive material dispensing systems.

A further object of the present invention is to provide a new and improved hot melt adhesive material dispensing system for use in connection with a pair of multiple-outlet or multiple-output planetary metering gear pumps for supplying hot melt adhesive material to an array of diversion flow control valves wherein, in order to in fact supply, route, or conduct the hot melt adhesive material from the multiple-output gear pumps to the individual diversion flow valves of the array of flow control valves so as to achieve a particular hot melt adhesive deposition pattern, the particular fluid flow circuitry as desired and required is able to be provided and yet the number of adhesive manifold plates, the number of corresponding fluidic seals, and the number of potential leakage sites, is able to be substantially reduced.

A last object of the present invention is to provide a new and improved hot melt adhesive material dispensing system for use in connection with a pair of multiple-outlet or multiple-output planetary metering gear pumps for supplying hot melt adhesive material to an array of diversion flow control valves wherein, in order to in fact supply, route, or conduct the hot melt adhesive material from the multiple-output gear pumps to the individual diversion flow control valves so as to achieve a particular hot melt adhesive deposition pattern, the particular fluid flow circuitry as desired and required is able to be provided and yet the number of adhesive manifold plates is able to be reduced so as to minimize the overall size of the adhesive manifold, the number of seals operatively associated with the plurality of adhesive manifold plates, and the number of potential leakage paths or sites which would normally or otherwise be present in conjunction with a larger number of adhesive manifold plates characteristic of conventional or PRIOR ART adhesive manifolds utilized within conventional or PRIOR ART hot melt adhesive material dispensing systems, and wherein further, the assembly and disassembly of the adhesive manifold components is substantially simplified.

SUMMARY OF THE INVENTION

The foregoing and other objectives are achieved in accordance with the teachings and principles of the present invention through the provision of a new and improved hot melt adhesive material dispensing system, for use in connection with a pair of multiple-outlet or multiple-output planetary metering gear pumps for supplying hot melt adhesive material to a plurality of diversion flow control valves, wherein an adhesive manifold is fluidically associated with the pair of multiple-outlet or multiple-output planetary metering gear pumps and the plurality of diversion flow control valves so as to supply hot melt adhesive material to the array of diversion flow control valves. In particular, the adhesive manifold comprises an input manifold, a distribution, a recirculation plate, and an output manifold, and in accordance with the unique and novel fluidic arrangement constructed or developed in accordance with the principles and teachings of the present invention, fluid flow paths are provided upon opposite surfaces of the distribution and recirculation plates, as well as through such distribution and recirculation plates, with solid plate portions being effectively interposed between particular portions of such fluid flow paths so as to define, separate, and preserve the fluidic integrity of such fluid flow paths.

Considered alternatively, the fluid flow paths conventionally fabricated upon four plates are now effectively fabricated upon the opposite sides of two plates such that the fluid flow paths of four plates have been integrated onto two plates with solid plate portions interposed or integrally formed therebetween. In this manner, the intricate and relatively complex fluidic circuitry characteristic of the adhesive manifold is able to be provided and preserved, and yet the number of adhesive manifold plates is able to be reduced so as to in turn minimize the overall size of the adhesive manifold, the number of seals operatively associated with the plurality of adhesive manifold plates, and the number of potential leakage paths or sites which would normally or otherwise be present in conjunction with a larger number of adhesive manifold plates characteristic of conventional or PRIOR ART adhesive manifolds utilized within conventional or PRIOR ART hot melt adhesive material dispensing systems. In addition, the output manifold, the recirculation plate, and the distribution plate, as well as the multiple-outlet planetary metering gear pumps and the recirculation pump, are all readily and easily removed from the input manifold, and similarly with respect to the plurality of arrayed diversion flow valves and the adapter plate with respect to the output manifold, so as to enable operator personnel to easily, simply, and quickly perform any necessary maintenance, repair, parts replacement, cleaning, or similar operations upon the various major components of the system with a minimal amount of system operational downtime.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein:

FIG. 6*a* is a front elevational view of the adapter plate component of the new and improved hot melt adhesive material dispensing system as shown in FIG. 1;

FIG. 6*b* is a rear elevational view of the adapter plate component of the new and improved hot melt adhesive material dispensing system as shown in FIG. 1 and corresponding to the front elevational view of the adapter plate component as shown in FIG. 6*a*; and FIG. 6*c* is a left side elevational view of the adapter plate component of the new and improved hot melt adhesive material dispensing system as shown in FIG. 1 and corresponding to the front and rear elevational views of the adapter plate component as shown in FIGS. 6*a* and 6*b*.

DETAILED DESCRIPTION OF THE PREFERRED EMBODIMENT

Figure 1:
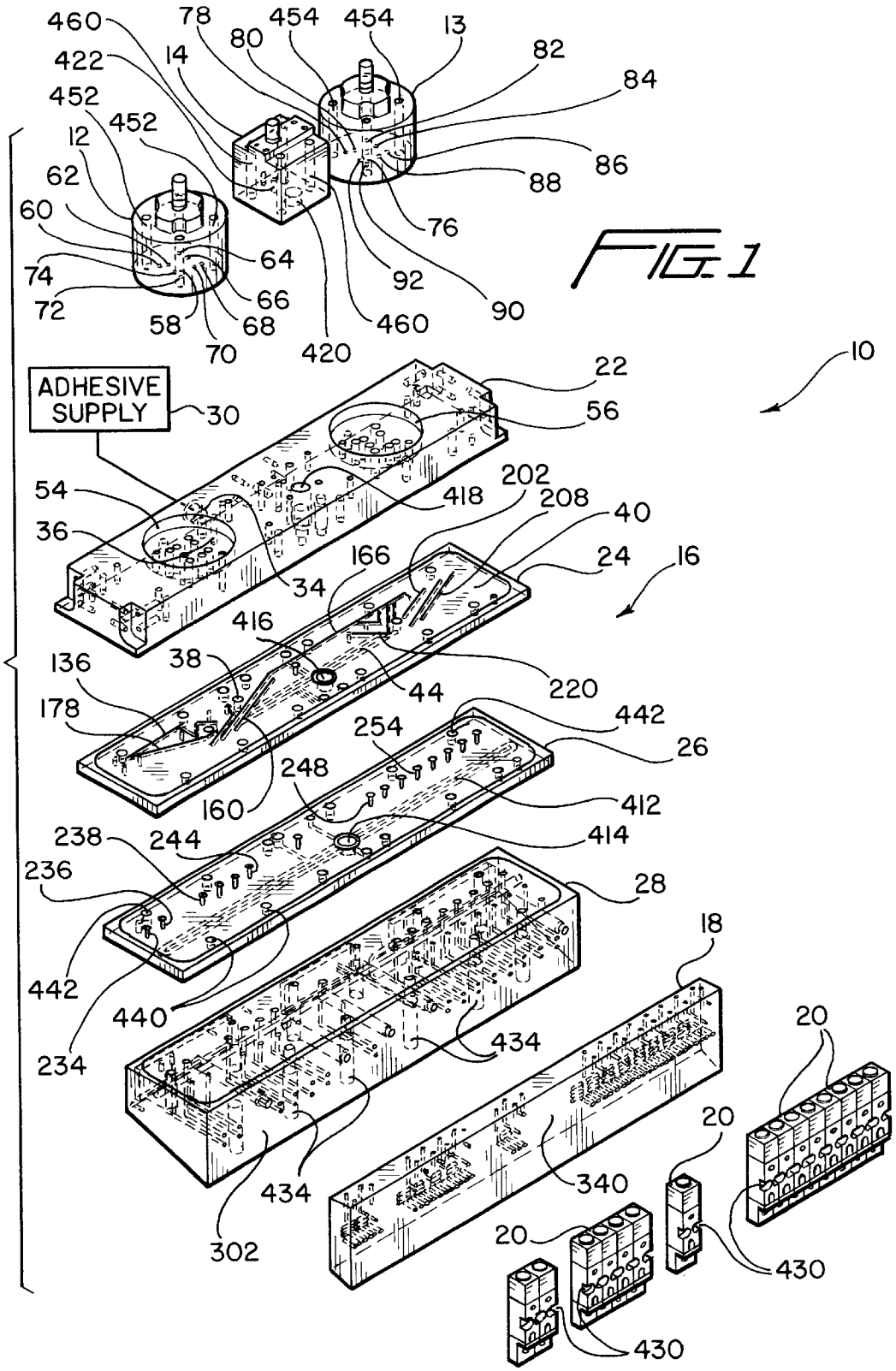
FIG. 1 is an exploded perspective view of a new and improved hot melt adhesive material dispensing system, for supplying hot melt adhesive material from a plurality of multiple-output planetary metering gear pumps to an array of diversion flow control valves, as constructed in accordance with the principles and teachings of the present invention so as to effectively minimize the number of fluid circuit plates within the adhesive manifold while simplifying assembly and disassembly of the adhesive manifold as may be necessary for maintenance, cleaning, and parts replacement purposes.

Referring now to the drawings, and more particularly to FIG. 1 thereof, a new and improved hot melt adhesive material dispensing system, for supplying hot melt adhesive material from a plurality of multiple-output planetary metering gear pumps to an array of diversion flow control valves in order to achieve a particular hot melt adhesive material deposition pattern, is disclosed and is generally indicated by the reference character 10. It is initially noted that while the drawings may disclose all of the detailed structure characteristic of the commercially operable system 10, only those components or structure truly relevant to the understanding of the overall operation of the new and improved hot melt adhesive material dispensing system 10 will be described within the present specification. More particularly then, the new and improved hot melt adhesive material dispensing system 10 is seen to comprise a pair of multiple-outlet planetary metering gear pumps 12,13, a recirculation pump 14, an adhesive manifold 16, an adapter plate 18, and a plurality of diversion flow valves 20 which are arranged within a particular longitudinal array.

It is further noted that the adhesive manifold 16 comprises an input manifold 22, a distribution plate 24, a recirculation plate 26, and an output manifold 28 within which the adhesive material will be heated so as to effectively provide hot melt adhesive material to the diversion flow valves 20. Adhesive material is initially supplied from a suitable supply source of adhesive material 30 to the input manifold 22 from which the adhesive material is in turn conducted to the distribution plate 24. From the distribution plate 24, the adhesive material is conducted back to the input manifold 22 so as to fluidically mate with the fluid inlets of the pair of multiple-outlet planetary metering gear pumps 12,13 which are mounted within the input manifold 22. The adhesive material is then conducted from the multiple outlets of the multiple-outlet planetary metering gear pumps 12,13 to a predetermined corresponding array of inlets formed within the distribution plate 24 where, upon the adhesive material traversing predeterminedly configured flow paths defined within the distribution plate 24, the adhesive material is conducted through a predetermined array of outlets formed within the distribution plate 24 so as to in turn be conducted through a predetermined array of fluid passageways formed within the recirculation plate 26.

The fluid passageways formed within the recirculation plate 26 are adapted to be fluidically connected to corresponding fluid passageways formed within the output manifold 28, the fluid passageways formed within the output manifold 28 are adapted to be fluidically connected to corresponding supply fluid passageways formed within the adapter plate 18, and the supply fluid passageways formed within the adapter plate 18 are adapted to be respectively fluidically connected to individual ones of the plurality of diversion flow valves 20. If any particular one of the plurality of diversion flow valves 20 is disposed in its CLOSED state, the hot melt adhesive material supplied to such diversion flow valve 20 is then returned, by means of suitable return fluid passages defined within the adapter plate 18 and the output manifold 28, to the recirculation plate 26 from which the returned hot melt adhesive material is conducted through the distribution plate 24 and the input manifold 22 to the inlet of the recirculation pump 14. The outlet of the recirculation pump 14 is fluidically connected to a passageway extending through the input manifold 22 so as to be fluidically connected to the original adhesive material supply passageway formed within the distribution plate 24 whereby adhesive material is again supplied back to the input manifold 22 and the fluid inlets of the pair of multiple-outlet planetary metering gear pumps 12,13.

With reference now being made to the other drawings comprising the disclosure of this patent application, a detailed description of all of the component parts comprising the new and improved hot melt adhesive material dispensing system 10, as constructed in accordance with the principles and teachings of the present invention, will be described. With reference initially being made to FIGS. 2, 3*a*, and 3*b*, wherein the structures of the input manifold 22 and the distribution plate 24 are disclosed, it is seen from FIG. 2 that an inlet port 32 is formed upon the rear wall 33 of the input manifold 22 and is fluidically connected to the adhesive material supply 30 such that adhesive material can be supplied to inlet port 32 from the adhesive material supply 30. The inlet port 32 is integrally formed upon the upstream end of a horizontally extending fluidic connector or tap 34, and as can best be seen from FIGS. 1 and 2, a downstream end portion of the connector or tap 34 is fluidically connected to a vertically downwardly extending fluid passageway 36 which extends through the entire depth or thickness dimension or extent of the input manifold 22.

Continuing further, and as can best be appreciated from FIGS. 3*a* and 3*b*, the distribution plate 24 is provided with a vertically extending fluid passageway 38 which likewise extends through the entire depth or thickness dimension or extent of the distribution plate 24 so as to extend between the upper surface 40 of the distribution plate 24 and the lower surface 42 of the distribution plate 24. A longitudinally extending fluid flow path 44 is provided only upon the lower surface 42 of the distribution plate 24, and a transversely disposed fluid flow path 46 fluidically interconnects the longitudinally extending fluid flow path 44 of the distribution plate 24 to the vertically extending fluid passageway 38. Still yet further, it is seen from FIGURES 3*a* and 3*b* that oppositely disposed extreme end portions of the longitudinally extending fluid flow path 44 are provided with vertically upwardly extending fluid passageways 48,50 which extend through the entire depth or thickness dimension or extent of the distribution plate 24 so as to extend between the lower surface 42 of the distribution plate 24 and the upper surface 40 of the distribution plate 24.

Referring again to FIGS. 1,2*a* and 2*b*, it is seen that the upper surface portion 52 of the input manifold 22 is provided with a pair of longitudinally spaced recessed or counterbored regions 54,56 within which the pair of multiple outlet planetary metering gear pumps 12,13 are adapted to be respectively disposed, and it is noted that the multiple outlet planetary metering gear pump 12 comprises a centrally located inlet port 58 and eight circumferentially spaced outlet ports 60,62,64,66,68,70,72,74, while multiple outlet planetary metering gear pump 13 similarly comprises a centrally located inlet port 76 and eight circumferentially spaced outlet ports 78,80,82,84,86,88,90,92. In a similar manner, as best seen from FIGS. 2*a* and 2*b*, the recessed or counterbored region 54 of the input manifold 22 is provided with a vertically extending central fluid passageway 94 and eight vertically extending fluid passageways 96,98,100,102, 104,106,108,110 which extend through the entire depth or thickness dimension or extent of the input manifold 22 so as to extend between the bottom surface 112 of the recessed or counterbored region 54 and the lower surface 114 of the input manifold 22. Correspondingly, the recessed or counterbored region 56 of the input manifold 22 is provided with a vertically extending central fluid passageway 116 and eight vertically extending fluid passageways 118,120,122,124, 126, 128,130,132 which extend through the entire depth or thickness dimension or extent of the input manifold 22 so as to extend between the bottom surface 134 of the recessed or counterbored region 56 and the lower surface 114 of the input manifold 22. In this manner, it can readily be appreciated that the vertically upwardly extending fluid passageways 48,50 provided within the distribution plate 24 are adapted to be fluidically connected to the vertically extending central fluid passageways 94,116 provided within the input manifold 22 so as to respectively provide adhesive material to the central inlets 58,76 of the multiple-outlet planetary metering gear pumps 12,13, while the vertically extending fluid passageways 96,98,100,102,104,106,108, 110 and vertically extending fluid passageways 118,120,122, 124, 126,128,130,132 provided within the input manifold 22 provide adhesive material from the multiple-outlet planetary metering gear pumps 12,13 to the distribution plate 24.

With reference again being made to FIG. 3*a*, it is seen that the upper surface portion 40 of the distribution plate 24 is provided with a plurality of fluid flow paths or circuits which can effectively be considered to be the fluidic equivalents of electrical printed circuits provided upon a printed circuit board. As will become more apparent hereinafter, the plurality of fluid flow paths or circuits provide fluid flow for the adhesive material from predetermined input regions of the distribution plate 24, which positionally correspond to the fluidic outputs of the multiple-outlet planetary metering gear pumps 12,13, to predetermined output regions of the distribution plate 24 which positionally correspond to downstream fluid passageways that ultimately lead to the arrayed plurality of diversion flow valves 20. More particularly, the left side portion of the distribution plate 24 is seen to comprise a first fluid flow path or circuit 136 having an inlet end 138 and an outlet end 140, a second fluid flow path or circuit 142 having an inlet end 144 and an outlet end 146, a third fluid flow path or circuit 148 having an inlet end 150 and an outlet end 152, a fourth fluid flow path or circuit 154 having an inlet end 156 and an outlet end 158, a fifth fluid flow path or circuit 160 having an inlet end 162 and an outlet end 164, a sixth fluid flow path or circuit 166 having an inlet end 168 and an outlet end 170, a seventh fluid flow path or circuit 172 having an inlet end 174 and an outlet end 176, and an eighth fluid flow path or circuit 178 having an inlet end 180 and an outlet end 182. As a result of a comparison which can readily be made between the distribution plate 24 as disclosed within FIG. 3*a* and the input manifold 22 as disclosed within FIG. 2*a*, it can be appreciated that the locations of the inlet ends 138,144,150,156,162,168,174, 180 of the fluid flow paths 136,142,148,154,160,166,172, 178 upon the distribution plate 24 positionally correspond to the locations of the vertically extending fluid passageways 96,98, 100,102,104,106,108,110 of the input manifold 22 so as to be capable of fluidically receiving adhesive material from the vertically extending fluid passageways 96,98,100, 102,104, 106,108,110 of the input manifold 22.

In a similar manner, the right side portion of the distribution plate 24 is seen to comprise a first fluid flow path or circuit 184 having an inlet end 186 and an outlet end 188, a second fluid flow path or circuit 190 having an inlet end 192 and an outlet end 194, a third fluid flow path or circuit 196 which is actually formed upon the lower surface 42 of the distribution plate 42 and has a third inlet end 198 and an outlet end 200 as more clearly seen in FIG. 3*b*, a fourth fluid flow path or circuit 202 having an inlet end 204 and an outlet end 206, a fifth fluid flow path or circuit 208 having an inlet end 210 and an outlet end 212, a sixth fluid flow path or circuit 214 having an inlet end 216 and an outlet end 218, a seventh fluid flow path or circuit 220 having an inlet end 222 and an outlet end 224, and an eighth fluid flow path or circuit 226 having an inlet end 228 and an outlet end 230. As a result of a comparison which can readily be made between the distribution plate 24 as disclosed within FIG. 3*a* and the input manifold 22 as disclosed within FIG. 2*a*, it can likewise be appreciated that the locations of the inlet ends 186,192,198,204,210,216,222, 228 of the fluid flow paths 184,190,202,208,214,220,226 upon the distribution plate 24 positionally correspond to the locations of the vertically extending fluid passageways 118, 120,122,124,126,128,130, 132 of the input manifold 22 so as to be capable of fluidically receiving adhesive material from the vertically extending fluid passageways 118,120,122, 124,126,128,130,132 of the input manifold 22.

It is to be noted that the inlet 198 of the third fluid flow path or circuit 196 extends through the distribution plate 42, that the third fluid flow path or circuit 196 is formed upon the lower surface 42 of distribution plate 42, and that the outlet 200 is disposed in fluidic communication with the vertically upwardly extending fluid passageway 50 because in accordance with the particular exemplary array of diversion flow valves 20, only fifteen (15) diversion flow valves are present for achieving the particular hot melt adhesive material deposition pattern. Accordingly, only fifteen (15) adhesive material outlets 140,146,152,158, 164,170,176, 182,188,194,206,212,218,224,230 are required to be provided upon the distribution plate 24, and the adhesive material which is conducted through the inlet 198 and third fluid flow path or circuit 196 is immediately resupplied to the multiple-outlet planetary metering gear pump 13 by means of vertically upwardly extending fluid passageway 50.

Figure 3A:
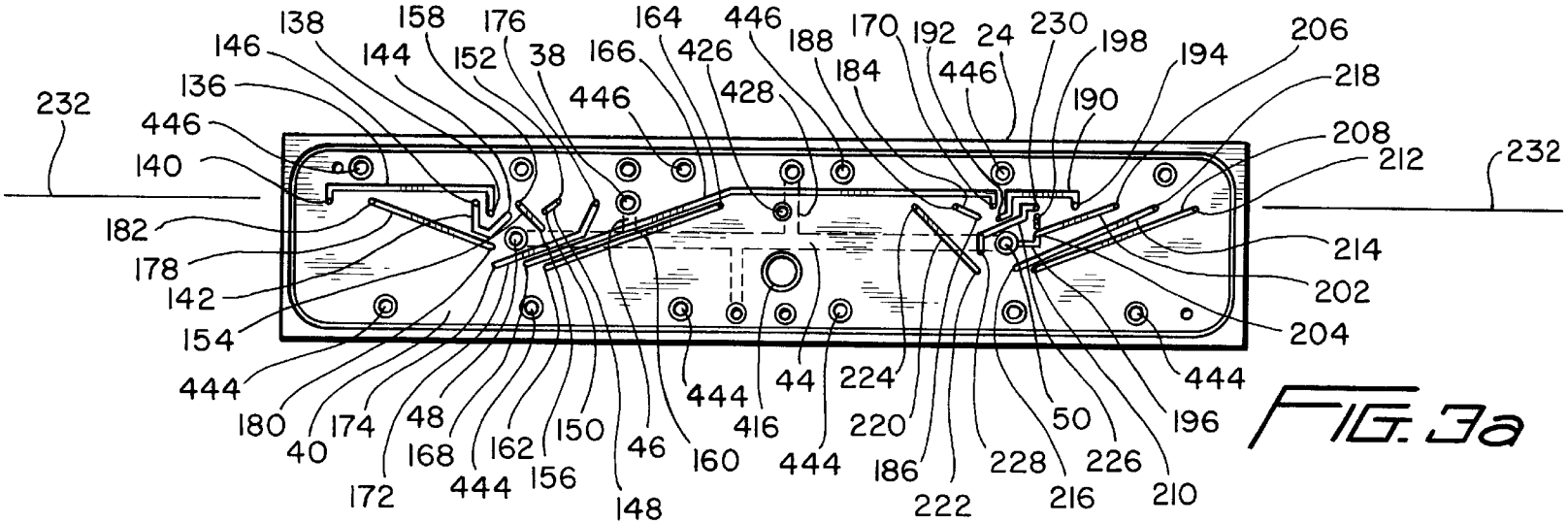
FIG. 3*a* is a top plan view of the distribution plate component of the new and improved hot melt adhesive material dispensing system as shown in FIG. 1.
Figure 4B:
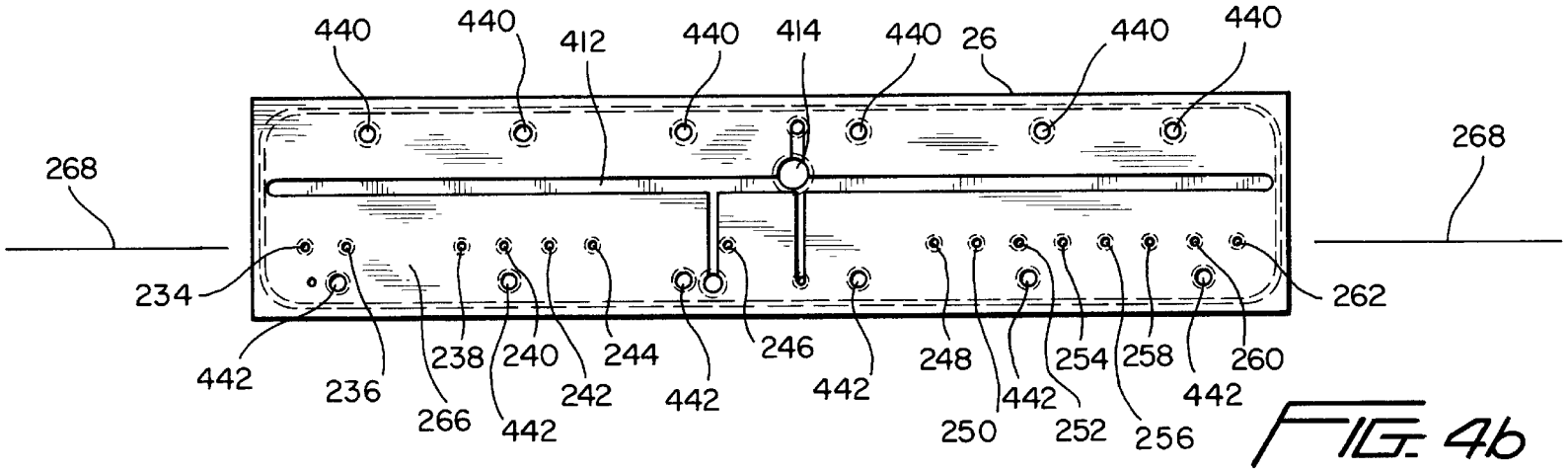
FIG. 4*b* is a bottom plan view of the recirculation plate component of the new and improved hot melt adhesive material dispensing system as shown in FIG. 1 and corresponding to the top plan view of the recirculation plate component as shown in FIG. 4*a*.
Figure 4A:
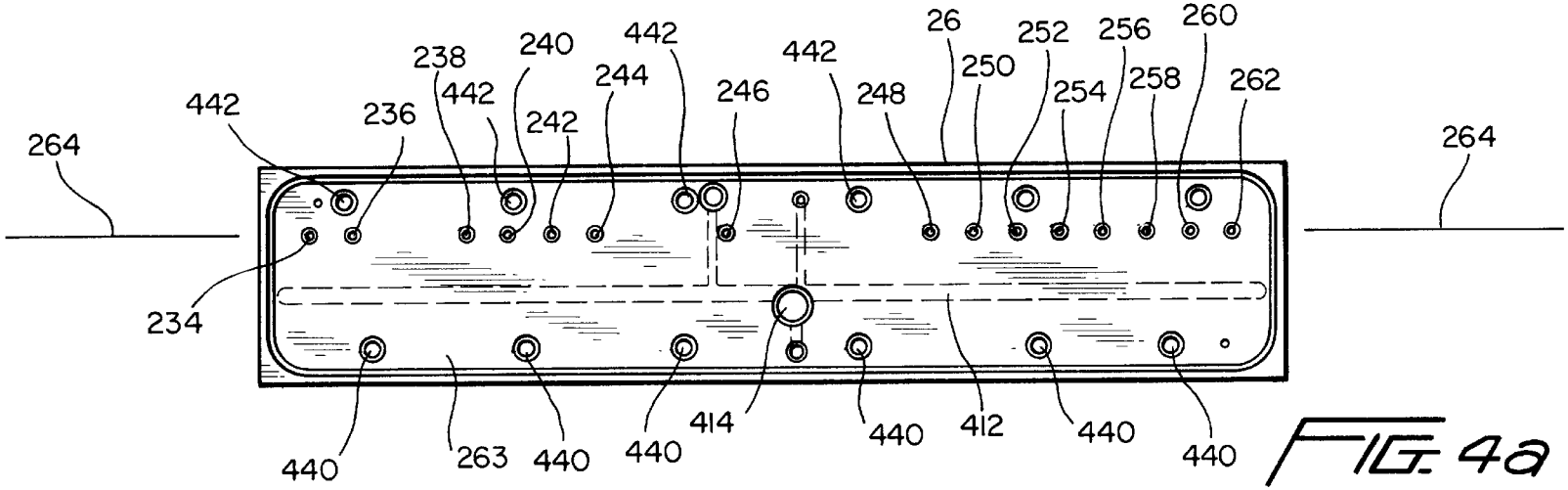
FIG. 4*a* is a top plan view of the recirculation plate component of the new and improved hot melt adhesive material dispensing system as shown in FIG. 1.

With reference now being made to FIGS. 1,3*a*,4*a*, and 4*b*, it is noted that all of the aforenoted fifteen (15) adhesive material outlets 140,146,152,158,164,170,176,182, 188, 194,206,212,218,224,230 extend through the distribution plate 24 and are also arranged within a linear array as schematically noted by the longitudinally extending line 232. In this manner, the adhesive material outlets 140,146, 152,158,164,170,176,182,188,194,206,212,218,224,230 of the distribution plate 24 are able to fluidically interface with the inlet ends of fifteen (15) vertically oriented fluid passageways 234,236,238,240,242,244,246,248,250,252,254, 256, 258,260,262 which extend through the recirculation plate 26 as can be appreciated from FIGS. 1,4*a*, and 4*b*. As is the case with the fifteen (15) adhesive material outlets 140, 146,152,158,164,170,176,182,188,194,206,212,218, 224,230 of the distribution plate 24, the inlet ends of the fifteen (15) vertically oriented fluid passageways 234,236, 238,240, 242,244,246,248,250,252,254,256,258,260,262 of the recirculation plate 26 are defined within the upper surface 263 of the recirculation plate 26 and are also longitudinally spaced in a linear array along a longitudinally extending line 264 as seen in FIG. 4*a*. In a similar manner, as seen in FIG. 4*b*, the outlet ends of the fifteen (15) vertically oriented fluid passageways 234,236,238,240,242, 244,246,248, 250,252,254,256,258,260,262 of the recirculation plate 26 are defined within the lower surface 266 of the recirculation plate 26 and are also longitudinally spaced in a linear array along a longitudinally extending line 268.

In this manner, the lower outlet ends of the fifteen (15) vertically oriented fluid passageways 234,236,238, 240,242, 244,246,248,250,252,254,256,258,260,262 extending through the recirculation plate 26 are able to fluidically interface with the upper inlet ends of fifteen (15) fluid passageways 270,272,274,276,288,280,282,284,286,288, 290,292, 294,296,298 which extend through the output manifold 28 as can be appreciated from FIGS. 1,5*a*,5*b*,5*c*, and 5*d*. It is seen that the fifteen (15) fluid passageways 270,272,274, 276,288,280,282,284,286,288,290,292,294, 296,298 of the output manifold 28 have substantially L-shaped configurations whereby the upper inlet ends of the fifteen (15) fluid passageways 270,272,274,276,288,280, 282,284,286,288,290,292,294, 296,298 are disposed within the upper surface 300 of the output manifold 28 along a linear array or locus 301 while the outlet ends of the fifteen (15) fluid passageways 270, 272,274,276,288,280,282,284, 286,288,290,292,294,296,298 are disposed within the front face 302 of the output manifold 28 along a linear array or locus 304. As a result of the provision of the substantially L-shaped fluid passageways 270, 272,274,276,288,280,282, 284,286,288,290,292,294,296,298 within the output manifold 28, and in addition, as a result of the disposition of the fluid inlets and fluid outlets of the fluid passageways 270, 272,274,276,288,280,282,284,286, 288,290,292,294,296, 298 along the linear arrays or loci 301 and 304, it is thus apparent that the output manifold 28 enables fluid flow for the adhesive material to be conducted from the recirculation plate 26 to the adapter plate 18. Output manifold 28 is also provided with suitable means, not actually shown, which are disposed within passageways 305, for controllably heating the adhesive material so as to render the same hot melt adhesive material when such is supplied to adapter plate 18 and the diversion flow valves 20.

With reference lastly being made to FIGS. 1,5*a*–5*d*, and 6*a*–6*c*, the details of the adapter plate 18, and its operative interaction with the output manifold 28, are disclosed, and it is seen that the adapter plate 18 is provided with a first lower array of fluid passageways 306,308,310, 312,314,316,318, 320,322,324,326,328,330,332,334 which are longitudinally aligned along a linear locus 336 and which pass through the entire thickness extent of the adapter plate 18 so as to extend from the rear surface wall 338 of the adapter plate 18 to the front surface wall 340 of the adapter plate 18. Each one of the fluid passageways 306,308, 310,312,314,316,318,320, 322,324,326,328,330,332,334 is adapted to be fluidically connected with a respective one of the fluid passageways 270,272,274,276,288,280,282,284,286, 288,290,292,294, 296,298 of the output manifold 28 so as to respectively receive a supply of hot melt adhesive material therefrom. In a similar manner, the adapter plate 18 is provided with a second upper array of fluid passageways 342, 344,346,348, 350,352,354,356,358,360,362,364,366,368,370 which are longitudinally aligned along a linear locus 372 and which pass through the entire thickness extent of the adapter plate 18 so as to extend from the front surface wall 340 of the adapter plate 18 to the rear surface wall 338 of the adapter plate 18. In this manner, each one of the fluid passageways 342,344,346,348,350,352,354,356,358,360,362,364, 366, 368,370 is adapted to be fluidically connected with a respective one of a second set of fluid passageways 374,376, 378,380,382,384,386,388,390,392,394,396,398,400,402 provided within the output manifold 28 so as to respectively conduct hot melt adhesive material back to the output manifold 28 when particular ones of the diversion flow valves 20 are disposed in a CLOSED state. In order to control the disposition of the diversion flow valves 20 between their OPEN and CLOSED states, the adapter plate 18 is further provided with a first set of substantially L-shaped CLOSE air passages 404 by means of which pneumatic control CLOSE air can respectively be conducted from the upper surface portion 405 of the adapter plate 18 to the front surface portion 340 of the adapter plate 18 for conveyance to each diversion flow valve module 20, and a second set of substantially L-shaped OPEN air passages 406 by means of which pneumatic control OPEN air can respectively be conducted from the upper surface portion 405 of the adapter plate 18 to the front surface portion 340 of the adapter plate 18 for conveyance to each diversion flow valve module 20.

As was the case with the first set of fluid passageways 270,272,274,276,288,280,282,284,286,288,290,292,294, 296,298 of the output manifold 28, the second set of fluid passageways 374,376,378,380,382,384,386,388,390,392, 394,396, 398,400,402 provided within the output manifold 28 also have substantially L-shaped configurations whereby return inlet ends of the fluid passageways 374,376,378,380, 382,384,386, 388,390,392,394,396,398,400,402 are disposed within a longitudinal array extending along a linear locus 408 which is defined within the front face 302 of the output manifold 28 and which corresponds to the linear locus 372 of the fluid passageways 342,344,346,348,350, 352,354,356,358,360,362,364, 366,368,370 disposed along the linear locus 372 of adapter plate 18, while return outlet ends of the fluid passageways 374,376,378,380,382,384, 386,388,390,392,394,396,398,400,402 are disposed within a longitudinal array extending along a linear locus 410 which is defined within the upper face 300 of the output manifold 28. As can be appreciated from FIGS. 1,4*a*, and 4*b*, the underside or lower surface 266 of the recirculation plate 26 is provided with a longitudinally extending fluid passageway 412 which is adapted to be in fluidic communication with the return outlet ends of the fluid passageways 374,376,378,380,382,384,386,388,390,392,394,396, 398, 400,402 as disposed within the longitudinal array extending along the linear locus 410 defined within the upper face 300 of the output manifold 28. In this manner, the hot melt adhesive material being returned from the plurality of diversion flow valves 20, when the same are disposed in their CLOSED states, is able to be conducted or conveyed to the recirculation plate 26.

As can be further appreciated from FIG. 4*b*, longitudinally extending fluid passageway 412 defined upon the underside or lower surface of recirculation plate 26 is also disposed in fluidic communication with a fluid passageway 414 which extends vertically upwardly through the recirculation plate 26 from the lower surface portion 266 thereof to the upper surface portion 263 thereof. As can likewise be appreciated from FIGS. 1,3*a*, and 3*b*, the distribution plate 24 is also provided with a fluid passageway 416 which extends vertically upwardly therethrough from the lower surface portion 42 thereof to the upper surface portion 40 thereof and which is adapted to be in fluidic communication with the vertically upwardly extending fluid passageway 414 defined through the recirculation plate 26. In a similar manner, as can be appreciated with reference being made to FIGS. 1,2*a*, and 2*b*, a fluid passageway 418 extends vertically upwardly through the input manifold 22 from the lower surface portion 114 thereof to the upper surface portion thereof 52 and is adapted to be in fluidic communication with the vertically oriented fluid passageway 416 defined within the distribution plate 24.

Figure 2A:
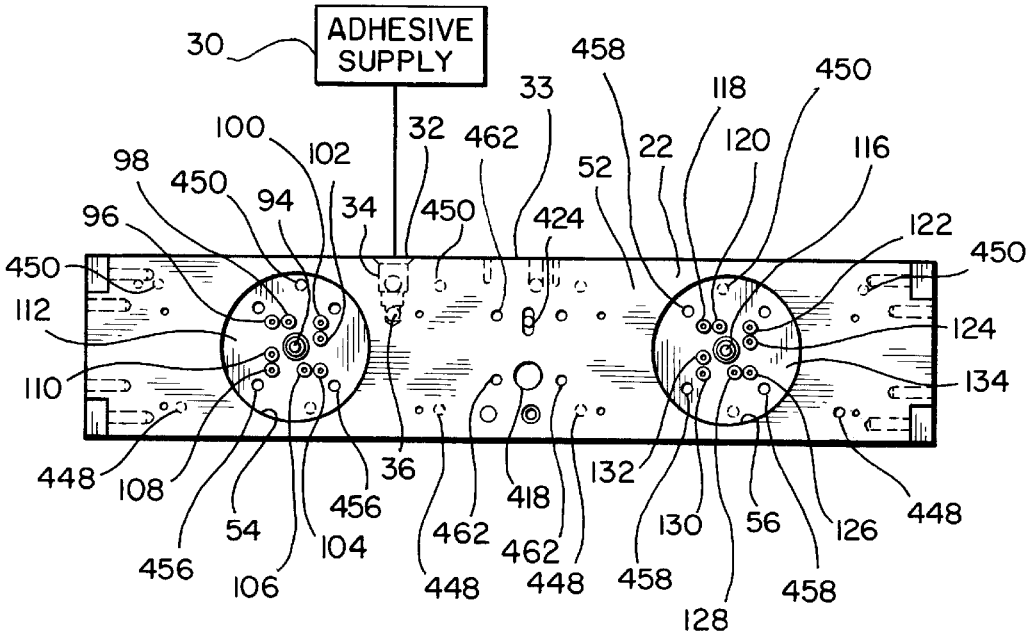
FIG. 2*a* is a top plan view of the input manifold component of the new and improved hot melt adhesive material dispensing system as shown in FIG. 1.
Figure 2B:
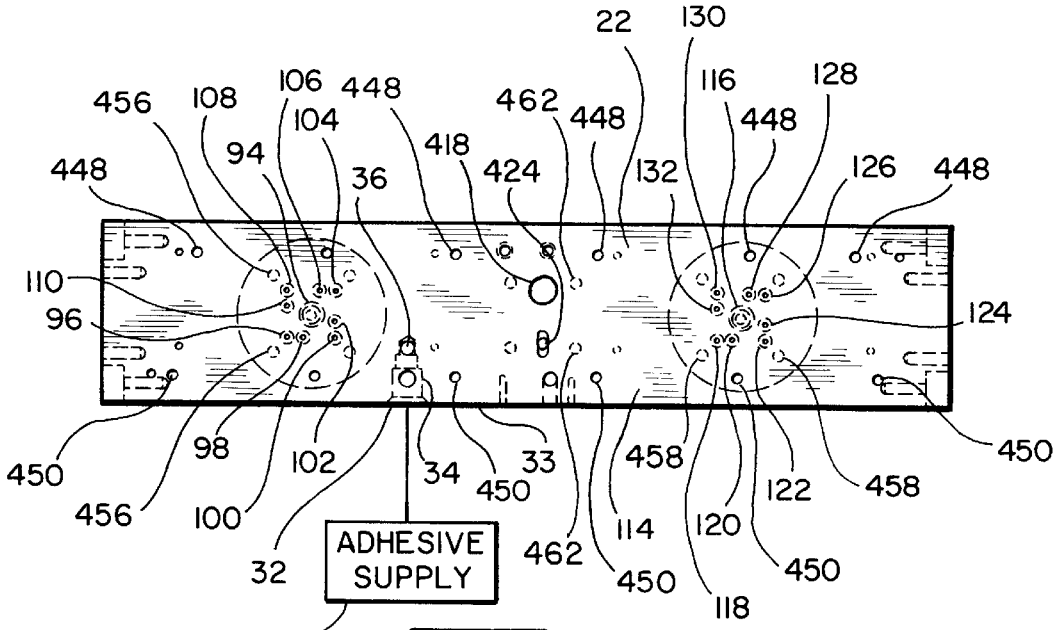
FIG. 2*b* is a bottom plan view of the input manifold component of the new and improved hot melt adhesive material dispensing system as shown in FIG. 1 and corresponding to the top plan view of the input manifold component as shown in FIG. 2*a*.
Figure 3B:
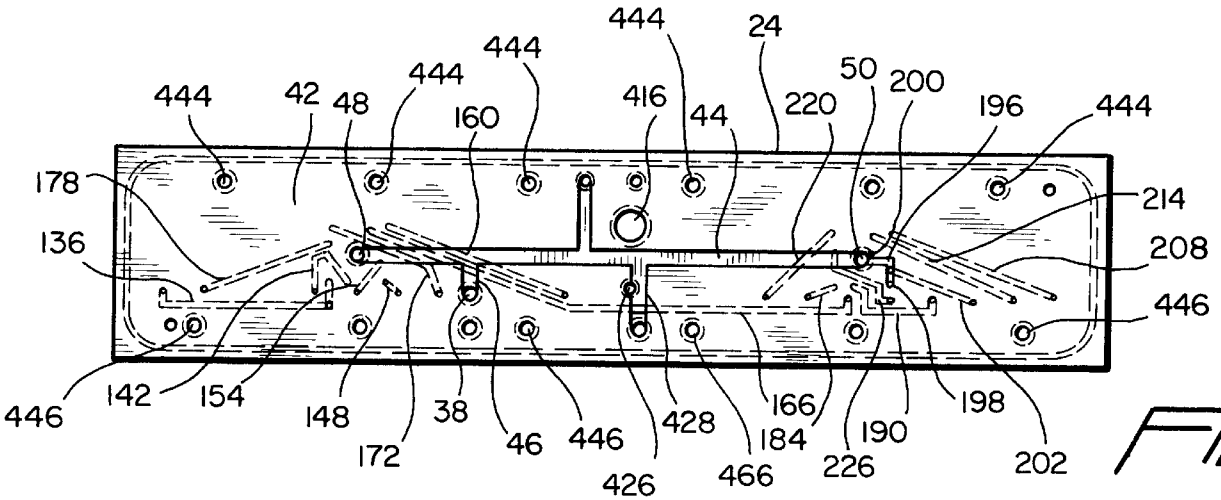
FIG. 3*b* is a bottom plan view of the distribution plate component of the new and improved hot melt adhesive material dispensing system as shown in FIG. 1 and corresponding to the top plan view of the distribution plate component as shown in FIG. 3*a*.

In this manner, the returning or recirculating hot melt adhesive material can be conducted to the inlet 420 of the recirculation pump 14 from which the hot melt adhesive material is conveyed through an oultet 422 toward a fluid passageway 424, best seen in FIGS. 2*a*,2*b*, defined within the input manifold 22 and extending vertically downwardly through the same from the upper surface portion 52 thereof to the lower surface portion 114 thereof. Accordingly, fluid passageway 424 is able to be in fluidic communication with a vertically oriented fluid passageway 426 which extends downwardly through the distribution plate 24 so as to be disposed in fluidic communication with a fluid pathway 428 which is formed upon the underside or lower surface portion 42 of the distribution plate 24 and effectively forms a branch or arm of longitudinally extending fluid flow path 44. In this manner, the returned or recirculated hot melt adhesive material is able to be conducted by means of fluid flow path 44 to the upwardly extending fluid passageways 48,50 for conveyance to the multiple-outlet planetary metering gear pumps 12,13.

In accordance with a last primary or major feature of the present invention, it has been previously noted that a desirable feature of the new and improved hot melt adhesive material dispensing system 10 of the present invention is to independently mount as many of the primary or major operative components of the system 10 as is possible such that if any one particular component of the system 10 requires maintenance, cleaning, repair, replacement, or the like, then only that component, or a small number of related A-components, needs to be disassembled from the overall structural system 10 thereby significantly rendering the maintenance, cleaning, repair, or replacement operation easier to perform while significantly reducing the amount of time required to disassemble and re-assemble the various components of the system 10, and therefore the amount of operational downtime of the system 10. Therefore, in accordance with the teachings and principles of the present invention, and as can be best appreciated from FIGS. 1,6*a*, and 6*b*, it is seen that each one of the diversion flow valve modules 20 is provided with a pair of laterally spaced mounting recesses 430 through which, for example, suitable bolt fasteners, not shown, can be inserted for attaching each diversion flow valve module 20 to the adapter plate 18,and correspondingly, the adapter plate 18 is provided with a pair of laterally spaced bolt holes 432 within which the aforenoted bolt fasteners, not shown, can be threadedly secured so as to in fact secure the diversion flow valve modules 20 upon the front face 340 of the adapter plate 18.

Figures 5A, 5B, 5C, 5D:
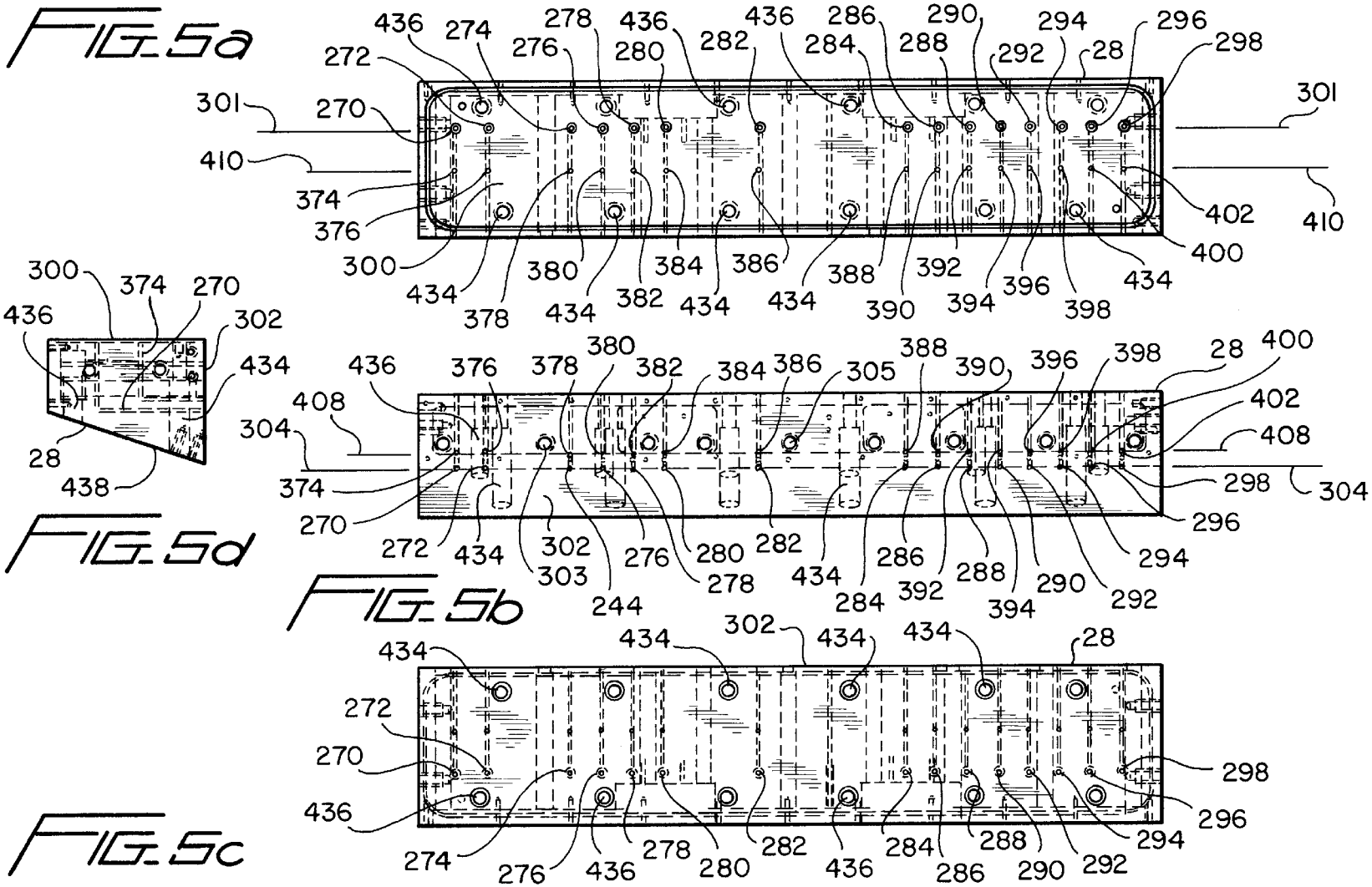
FIG. 5*a* is a top plan view of the output manifold component of the new and improved hot melt adhesive material dispensing system as shown in FIG. 1.
FIG. 5*b* is a front elevational view of the output manifold component of the new and improved hot melt adhesive material dispensing system as shown in FIG. 1 and corresponding to the top plan view of the distribution plate component as shown in FIG. 5*a*.
FIG. 5*c* is a bottom plan view of the output manifold component of the new and improved hot melt adhesive material dispensing system as shown in FIG. 1 and corresponding to the top plan and front elevational views of the output manifold component as shown in FIGS. 5*a* and 5*b;*
FIG. 5*d* is a left side elevational view of the output manifold component of the new and improved hot melt adhesive material dispensing system as shown in FIG. 1 and corresponding to the top plan, front elevational, and bottom plan views of the output manifold component as shown in FIGS. 5*a*–5*c;*

In a similar manner, as may best be appreciated from FIGS. 1,5*b*, and 5*b*, both the adapter plate 18 and the output manifold 28 can be provided with a plurality of, for example, bolt holes, not actually shown, by means of which the adapter plate 18 can be secured, for example, to the front face 302 of the output manifold 28 by means of suitable fasteners, also not shown. In turn, as can be appreciated from additional reference being made to FIG. 5C, a plurality of first and second, forward and rearward, vertically oriented bolt holes 434,436 extend upwardly from the lower surface 438 of the output manifold 28 so as to extend through the entire vertical extent or depth of the output manifold 28 from the lower surface 438 thereof to the upper or top surface 300 thereof. Similar forward and rearward arrays of bolt holes 440,442, which are respectively vertically aligned with the bolt holes 434,436 of the output manifold 28, extend through the entire vertical extent or depth of the recirculation plate 26 from the lower surface 266 thereof to the top or upper surface 263 thereof as can best be appreciated from FIGS. 4*a* and 4*b*, and still yet further, similar forward and rearward arrays of bolt holes 444, 446, which are respectively vertically aligned with the bolt holes 440,442 of the recirculation plate 26 and the bolt holes 434,436 of the output manifold 28, extend through the entire vertical extent or depth of distribution plate 24 from the lower surface 42 thereof to the upper surface 40 thereof as can best be appreciated from FIGS. 3*a* and 3*b*. Lastly, as can likewise be appreciated from additional reference being made to FIGS. 2*a* and 2*b*, forward and rearward arrays of bolt holes 448,450, which are respectively vertically aligned with the bolt holes 444, 446 of the distribution plate 24, the bolt holes 440,442 of the recirculation plate 26, and the bolt holes 434,436 of the output manifold 28, extend upwardly through the bottom surface 114 of the input manifold 22. In this manner, the output manifold 28, recirculation plate 26, and the distribution plate 24 can be fixedly mounted and secured upon the undersurface 114 of the input manifold 22 by means of suitable bolt fasteners, not shown.

In order to fixedly mount and secure the multiple-outlet planetary metering gear pumps 12,13 within their recessed or counterbored regions 54,56 of the input manifold 22, as can best be appreciated from FIGS. 1,2*a*, and 2*b*, the multiple-outlet planetary metering gear pumps 12,13 are respectively provided with a plurality of through-bores 452,454, and the recessed or counterbored regions 54,56 of the input manifold 22 are respectively provided with a plurality of blind bores 456,458. Accordingly, when suitable bolt fasteners, not shown, are inserted through the bores 452,454 of the multiple-outlet planetary metering gear pumps 12,13 and threadedly engaged within the blind bores 456,458 of the input manifold 22, the multiple-outlet planetary metering gear pumps 12,13 will be fixedly secured to the input manifold 22. In a similar manner, the recirculation pump 14 is provided with a plurality of through-bores 460 and the upper surface portion 52 of the input manifold 22 is provided with a plurality of blind bores 462. Consequently, when suitable bolt fasteners, not shown, are passed through the bores 460 of the recirculation pump 14 and threadedly secured within the bores 462 of the input manifold 22, the recirculation pump 14 will be fixedly secured to the upper surface portion 52 of the input manifold 22. It can therefore be readily appreciated that as a result of the aforenoted structure, each one of the multiple-outlet planetary metering gear pumps 12,13 and the recirculation pump 14 can be independently secured to and removed from the upper surface portions of input manifold 22 without affecting the disposition of the distribution plate 24, the recirculation plate 26, the output manifold 28, the adapter plate 18, and the diversion flow control valves 20. In a similar manner, the three distribution plate 24, recirculation plate 26, and output manifold 28 components can together be secured to and removed from the lower surface portion of the input manifold 22 independent of the mounting and securement of the multiple-outlet planetary metering gear pumps 12,13 and the recirculation pump 14 upon the upper surface portion of the input manifold 22, and still yet further, the adapter plate 18 can be mounted upon the output manifold 28 in an independent manner without requiring the disassembly of the output manifold 28, the multiple-outlet pumps 12,13, or the recirculation pump 14 from the input manifold 22, and each one of the diversion flow valve modules 20 can be independently mounted upon the adapter plate 18, as well as dependently mounted upon the output manifold 28 through means of the adapter plate 18, without likewise requiring disassembly of the output manifold 28, the multiple-outlet pumps 12,13, or the recirculation pump 14 from the input manifold 22.

Thus, it may be seen that in accordance with the principles and teachings of the present invention, fluid circuit flow paths have been effectively provided and incorporated upon opposite surfaces of two distribution and recirculation plates, with solid plate portions effectively being defined therebetween, whereby the number of fluid flow path plates has been halved and therefore significantly reduced with a corresponding reduction in the number of seal members required for such plates and the various fluid path connections thereof, as well as the number of potential sites from which fluid leakage can occur. In addition, the mounting and attachment of the various major components of the system has been simplified whereby each major component of the system, or a relatively small number of components, can be independently mounted within the system such that if a particular one of the components requires maintenance, repair, cleaning, replacement, or the like, only that component, or the relatively small number of components, needs to be disassembled, removed, and re-assembled, thereby rendering such operations relatively quick with a minimum of system operational downtime.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A hot melt adhesive material flow control system, comprising:

an input manifold for receiving a supply of adhesive material from a supply source of adhesive material;

a plurality of flow control valves for controlling the discharge of adhesive material therefrom such that adhesive material discharged from said plurality of flow control valves can be deposited upon a substrate in accordance with a predetermined pattern;

at least one multiple-outlet pump for discharging adhesive material received from said input manifold toward said plurality of flow control valves;

an output manifold within which the adhesive material discharged by said at least one multiple-outlet pump is heated so as to supply hot melt adhesive material to said plurality of flow control valves; and a first plate interposed between said input manifold and said output manifold and having first and second separate and independent fluid flow paths defined upon first and second opposite surfaces of said first plate, with a solid plate portion defined between said first and second opposite surfaces and said first and second separate and independent fluid flow paths defined upon said first and second opposite surfaces of said first plate, for respectively conducting adhesive material from said input manifold to said at least one multiple-outlet pump along said first fluid flow path, and from said at least one multiple-outlet pump toward said output manifold and said plurality of flow control valves along said second fluid flow path.

2. The system as set forth in claim 1, further comprising:

a second plate interposed between said first plate and said output manifold and having first and second separate and independent fluid flow paths defined upon first and second opposite surfaces of said second plate, with a solid plate portion defined between said first and second opposite surfaces and said first and second separate and independent fluid flow paths defined upon said first and second opposite surfaces of said second plate, for respectively conducting adhesive material from said first plate to said output manifold along said first fluid flow path, and from said output manifold toward said first plate along said second fluid flow path.

3. The system as set forth in claim 2, wherein:

said at least one multiple-outlet pump comprises a pair of multiple-outlet pumps fixedly mounted upon said input manifold.

4. The system as set forth in claim 3, wherein:

said first fluid flow path defined upon said first surface of said first plate has a single inlet end fluidically connected to said input manifold, and a pair of outlet ends respectively fluidically connected to inlets of said pair of multiple-outlet pumps.

5. The system as set forth in claim 4, wherein:

said second fluid flow path defined upon said second surface of said first plate comprises a plurality of fluid circuits each of which comprises an inlet end respectively fluidically connected to an outlet of said pair of multiple-outlet pumps, and an outlet end respectively fluidically connected to one of said plurality of flow control valves.

6. The system as set forth in claim 5, wherein:

said outlet ends of said plurality of fluid circuits of said second fluid flow path defined upon said second surface of said first plate are disposed within a first linear array; and said first fluid flow path defined upon said first surface of said second plate comprises a plurality of fluid passageways having inlet and outlet ends disposed within a second linear array which corresponds to said first linear array of outlet ends of said plurality of fluid circuits of said second fluid flow path defined upon said second surface of said first plate so as to fluidically conduct adhesive material from said first plate toward said output manifold.

7. The system as set forth in claim 6, wherein:

said second fluid flow path defined upon said second surface of said second plate comprises a linear fluid passageway; and said output manifold comprises a first set of fluid passageways having inlet ends disposed within a third linear array which corresponds to said second linear array of outlet ends of said plurality of fluid passageways of said first fluid flow path defined upon said first surface of said second plate so as to fluidically conduct adhesive material from said second plate toward said plurality of flow control valves, and a second set of fluid passageways having outlet ends disposed within a fourth linear array which corresponds to said linear fluid passageway of said second fluid flow path defined upon said second surface of said second plate so as to fluidically conduct adhesive material from said plurality of flow control valves back toward said first plate.

8. The system as set forth in claim 7, further comprising:

a recirculation pump having an inlet fluidically connected to said linear fluid passageway of said second fluid flow path defined upon said second surface of said second plate, and an outlet fluidically connected to said first fluid flow path defined upon said first surface of said first plate, for recirculating adhesive material from said plurality of flow control valves back to said pair of multiple-outlet pumps.

9. A material flow control system, comprising:

an input manifold for receiving a supply of material from a supply source of material;

a plurality of flow control valves for controlling the discharge of material therefrom such that material discharged from said plurality of flow control valves can be deposited upon a substrate in accordance with a predetermined pattern;

at least one multiple-outlet pump for discharging material received from said input manifold toward said plurality of flow control valves;

an output manifold for supplying material to said plurality of flow control valves; and a first plate interposed between said input manifold and said output manifold and having first and second separate and independent fluid flow paths defined upon first and second opposite surfaces of said first plate, with a solid plate portion defined between said first and second opposite surfaces and said first and second separate and independent fluid flow paths defined upon said first and second opposite surfaces of said first plate, for respectively conducting material from said input manifold to said at least one multiple-outlet pump along said first fluid flow path, and from said at least one multiple-outlet pump toward said output manifold and said plurality of flow control valves along said second fluid flow path.

10. The system as set forth in claim 9, further comprising:

a second plate interposed between said first plate and said output manifold and having first and second separate and independent fluid flow paths defined upon first and second opposite surfaces of said second plate, with a solid plate portion defined between said first and second opposite surfaces and said first and second separate and independent fluid flow paths defined upon said first and second opposite surfaces of said second plate, for respectively conducting material from said first plate to said output manifold along said first fluid flow path, and from said output manifold toward said first plate along said second fluid flow path.

11. The system as set forth in claim 10, wherein:

said at least one multiple-outlet pump comprises a pair of multiple-outlet pumps fixedly mounted upon said input manifold.

12. The system as set forth in claim 11, wherein:

said first fluid flow path defined upon said first surface of said first plate has a single inlet end fluidically connected to said input manifold, and a pair of outlet ends respectively fluidically connected to inlets of said pair of multiple-outlet pumps.

13. The system as set forth in claim 12, wherein:

said second fluid flow path defined upon said second surface of said first plate comprises a plurality of fluid circuits each of which comprises an inlet end respectively fluidically connected to an outlet of said pair of multiple-outlet pumps, and an outlet end respectively fluidically connected to one of said plurality of flow control valves.

14. The system as set forth in claim 13, wherein:

said outlet ends of said plurality of fluid circuits of said second fluid flow path defined upon said second surface of said first plate are disposed within a first linear array; and said first fluid flow path defined upon said first surface of said second plate comprises a plurality of fluid passageways having inlet and outlet ends disposed within a second linear array which corresponds to said first linear array of outlet ends of said plurality of fluid circuits of said second fluid flow path defined upon said second surface of said first plate so as to fluidically conduct material from said first plate toward said output manifold.

15. The system as set forth in claim 14, wherein:

said second fluid flow path defined upon said second surface of said second plate comprises a linear fluid passageway; and said output manifold comprises a first set of fluid passageways having inlet ends disposed within a third linear array which corresponds to said second linear array of outlet ends of said plurality of fluid passageways of said first fluid flow path defined upon said first surface of said second plate so as to fluidically conduct material from said second plate toward said plurality of flow control valves, and a second set of fluid passageways having outlet ends disposed within a fourth linear array which corresponds to said linear fluid passageway of said second fluid flow path defined upon said second surface of said second plate so as to fluidically conduct material from said plurality of flow control valves back toward said first plate.

16. The system as set forth in claim 15, further comprising:

a recirculation pump having an inlet fluidically connected to said linear fluid passageway of said second fluid flow path defined upon said second surface of said second plate, and an outlet fluidically connected to said first fluid flow path defined upon said first surface of said first plate, for recirculating material from said plurality of flow control valves back to said pair of multiple-outlet pumps.

17. A hot melt adhesive material flow control system, comprising:

an input manifold for receiving a supply of adhesive material from a supply source of adhesive material;

a plurality of flow control valves for controlling the discharge of adhesive material therefrom such that adhesive material discharged from said plurality of flow control valves can be deposited upon a substrate in accordance with a predetermined pattern;

at least one multiple-outlet pump for discharging adhesive material received from said input manifold toward said plurality of flow control valves;

an output manifold within which the adhesive material discharged by said at least one multiple-outlet pump is heated so as to supply hot melt adhesive material to said plurality of flow control valves;

an adapter plate for mounting said plurality of flow control valves thereon in a predetermined arrangement such that adhesive material can be discharged from said plurality of flow control valves and deposited upon the substrate in accordance with the predetermined pattern;

a recirculation pump for recirculating adhesive material from said plurality of flow control valves back to said at least one multiple-outlet pump; and means for mounting said plurality of flow control valves upon said adapter plate, for mounting said adapter plate upon said output manifold, for mounting said output manifold upon said input manifold, for mounting said at least one multiple-outlet pump upon said input manifold, and for mounting said recirculation pump upon said input manifold, in such a manner that said flow control valves can be disassembled from said adapter plate independent of disassembly of said adapter plate from said output manifold, as well as disassembly of said output manifold, said recirculation pump, and said at least one multiple-outlet pump from said input manifold; said adapter plate can be disassembled from said output manifold independent of disassembly of said output manifold, said recirculation pump, and said at least one multiple-output pump from said input manifold; and each one of said recirculation pump and said at least one multiple-outlet pump can be disassembled from said input manifold independent of disassembly of said output manifold, said adapter plate, and said plurality of flow control valves from said input manifold.

18. The system as set forth in claim 17, further comprising:

a first plate interposed between said input manifold and said output manifold and having first and second separate and independent fluid flow paths defined upon first and second opposite surfaces of said first plate, with a solid plate portion defined between said first and second opposite surfaces and said first and second separate and independent fluid flow paths defined upon said first and second opposite surfaces of said first plate, for respectively conducting adhesive material from said input manifold to said at least one multiple-outlet pump along said first fluid flow path, and from said at least one multiple-outlet pump toward said output manifold and said plurality of flow control valves along said second fluid flow path.

19. The system as set forth in claim 18, further comprising:

a second plate interposed between said first plate and said output manifold and having first and second separate and independent fluid flow paths defined upon first and second opposite surfaces of said second plate, with a solid plate portion defined between said first and second opposite surfaces and said first and second separate and independent fluid flow paths defined upon said first and second opposite surfaces of said second plate, for respectively conducting adhesive material from said first plate to said output manifold along said first fluid flow path, and from said output manifold toward said first plate along said second fluid flow path.

20. The system as set forth in claim 19, wherein:

said at least one multiple-outlet pump comprises a pair of multiple-outlet pumps fixedly mounted upon said input manifold.

21. The system as set forth in claim 20, wherein:

said first fluid flow path defined upon said first surface of said first plate has a single inlet end fluidically connected to said input manifold, and a pair of outlet ends respectively fluidically connected to inlets of said pair of multiple-outlet pumps.

22. The system as set forth in claim 21, wherein:

said second fluid flow path defined upon said second surface of said first plate comprises a plurality of fluid circuits each of which comprises an inlet end respectively fluidically connected to an outlet of said pair of multiple-outlet pumps, and an outlet end respectively fluidically connected to one of said plurality of flow control valves.

23. The system as set forth in claim 22, wherein:

said outlet ends of said plurality of fluid circuits of said second fluid flow path defined upon said second surface of said first plate are disposed within a first linear array; and said first fluid flow path defined upon said first surface of said second plate comprises a plurality of fluid passageways having inlet and outlet ends disposed within a second linear array which corresponds to said first linear array of outlet ends of said plurality of fluid circuits of said second fluid flow path defined upon said second surface of said first plate so as to fluidically conduct adhesive material from said first plate toward said output manifold.

24. The system as set forth in claim 23, wherein:

said second fluid flow path defined upon said second surface of said second plate comprises a linear fluid passageway; and said output manifold comprises a first set of fluid passageways having inlet ends disposed within a third linear array which corresponds to said second linear array of outlet ends of said plurality of fluid passageways of said first fluid flow path defined upon said first surface of said second plate so as to fluidically conduct adhesive material from said second plate toward said plurality of flow control valves, and a second set of fluid passageways having outlet ends disposed within a fourth linear array which corresponds to said linear fluid passageway of said second fluid flow path defined upon said second surface of said second plate so as to fluidically conduct adhesive material from said plurality of flow control valves back toward said first plate.

25. The system as set forth in claim 24, wherein:

said recirculation pump has an inlet fluidically connected to said linear fluid passageway of said second fluid flow path defined upon said second surface of said second plate, and an outlet fluidically connected to said first fluid flow path defined upon said first surface of said first plate, for recirculating adhesive material from said plurality of flow control valves back to said pair of multiple-outlet pumps.

* * * * *